United States Patent [19]

Kircher

[11] 4,315,811

[45] Feb. 16, 1982

[54] REINFORCED METAL CHANNELS FOR CELL FRAME

[75] Inventor: Morton S. Kircher, Clearwater, Fla.

[73] Assignee: Olin Corporation, New Haven, Conn.

[21] Appl. No.: 157,917

[22] Filed: Jun. 6, 1980

Related U.S. Application Data

[63] Continuation-in-part of Ser. No. 128,684, Mar. 10, 1980.

[51] Int. Cl.[3] ..... C25B 9/02; C25B 11/00

[52] U.S. Cl. ..... 204/279; 204/288

[58] Field of Search ..... 204/279, 286–289, 204/252–258, 263–266, 267–269; 52/823–826

[56] References Cited

U.S. PATENT DOCUMENTS

| | | | |
|---|---|---|---|
| 1,269,078 | 6/1918 | Hamilton | 204/279 X |
| 3,980,545 | 9/1976 | de Lachaux et al. | 204/286 |
| 4,069,129 | 1/1978 | Sato et al. | 204/258 |
| 4,111,779 | 9/1978 | Seko et al. | 204/255 |
| 4,132,622 | 1/1979 | Kenney | 204/288 X |
| 4,137,144 | 1/1979 | Kenney | 204/268 |
| 4,175,025 | 11/1979 | Creamer et al. | 204/253 |
| 4,210,516 | 7/1980 | Mosé et al. | 204/284 |
| 4,211,627 | 7/1980 | Cunningham | 204/252 |
| 4,218,293 | 8/1980 | Nawrot | 204/286 X |

FOREIGN PATENT DOCUMENTS

| | | | |
|---|---|---|---|
| 2023181 | 12/1979 | United Kingdom | 204/252 |

*Primary Examiner*—Andrew Metz
*Assistant Examiner*—Donald R. Valentine
*Attorney, Agent, or Firm*—Ralph D'Alessandro; Donald F. Clements; Thomas P. O'Day

[57] ABSTRACT

An improved frame component for a frame of an electrode useful in a filter press cell having a channel or U-shaped configuration comprising an outer planar wall attached orthogonally to first and second planar side walls with a multiplicity of spaced rigid reinforcing members attached to first and second side walls.

13 Claims, 5 Drawing Figures

REINFORCED METAL CHANNELS FOR CELL FRAME

This application is a continuation-in-part of co-pending prior application Ser. No. 128,684, filed Mar. 10, 1980, entitled "MEMBRANE-ELECTRODE PACK ALKALI CHLORINE CELL".

This invention relates to frame electrodes for membrane type electrolytic cells and particularly to frames for electrodes for monopolar filter press cells.

Commercial cells for the production of chlorine and alkali metal hydroxides have been continually developed and improved over a period of time dating back to at least 1892. In general, chloralkali cells are of the deposited asbestos diaphragm type or the flowing mercury cathode type. During the past few years, developments have been made in cells employing ion exchange membranes (hereafter "membrane cells") which promise advantages over either diaphragm or mercury cells. It is desirable to take advantage of existing technology particularly in diaphragm cells, but it is also necessary to provide cell designs which meets the requirements of the membranes. Since suitable membrane materials such as those marketed by E. I. duPont de Nemours and Company under the trademark Nafion ® and by Asahi Glass Company Ltd. under the trademark Flemion ® are available principly in sheet form, the most generally used of the membrane cells are of the "filter press" type. In the filter press type of cell, membranes are clamped under pressure between the flanges of filter press frames. Filter press cells are usually of the bipolar type. In the filter press type of electrolytic cell, membranes are positioned between adjacent filter press frames. The construction and operation of a typical prior art filter press cell is described generally in U.S. Pat. No. 4,175,025, issued to Edward D. Creamer et al on Nov. 20, 1979. The teaching of that patent is incorporated herein in its entirety by reference. U.S. Pat. No. 4,069,129, issued to Kimihiko Sato et al on Jan. 17, 1978, discloses a variety of frames for filter press cells including hollow four wall members appearing to have a continuous perforated plate on the inside.

The prior art has given considerable attention to the electrode coating materials, diaphragm or ion exchange membrane composition and the like. As a result, little attention has been directed to much needed improvements for reducing cell frame cost and to means and methods for improving same.

With filter press cells, the frame material is generally thick solid construction since the frame is under considerable compressive force when assembled. Even more compressive force is applied to the frame when the filter press cell is operated under a pressure greater than atmospheric pressure.

In the design of electrode sections for filter press cells, it is advantageous to employ large planar surfaces for economic use of membranes and of electrode mesh, both of which are extraordinarily expensive materials.

Because of the very high cost of present filter press cell construction materials (titanium, ruthemium, nickel, fluorocarbon and carboxylic acid substituted membrane), among others, it is highly desirable to maximize current densities and to reduce voltage coefficients in operating chloralkali cells and to utilize the best mechanical and electrical advantage of the materials employed.

Cell construction which has been used, or proposed especially those for above atmospheric pressure has required heavy member construction and/or cyclindrical shape. Heavy walled construction, either with solid wall resistant metals such as titanium and nickel, or with steel, lined with resistant metal tends to be very expensive and consume large amounts of metal. For these reasons, pressure type chlorine alkali cells have not been developed, commercially beyond a minor fraction of the total North American chloralkali production. Construction, based on circular electrodes within a cylindrical container with dished heads, has been proposed as a means of meeting pressure means more economically. However, since major items, such as electrode materials are inherently produced in rectangular sheet form, the waste involved in cutting to conform these materials to circular configuration is a very serious deterrent to the use of circular electrodes.

OBJECTS OF THE INVENTION

It is an object of the present invention to provide a novel frame component for electrodes for use in monopolar filter press cells for the production of chlorine and caustic soda and oxychlorine compounds.

Another object of the present invention is to provide a novel frame component for electrodes for use in monopolar filter press cells having electrodes extending in a direction parallel to the path of current flow through the cell.

An additional object of the present invention is to provide a channel or a U-shaped frame component reinforced with occasionally spaced reinforcing members for a filter press cell electrode.

It is a further object of the present invention to provide a frame component comprised of relatively thin material, yet has sufficient resistance to compression provided by spaced reinforcing members.

BRIEF DESCRIPTION OF THE INVENTION

These and other objects of the invention are accomplished in an improved frame component for a frame of an electrode useful in a filter press type electrolytic cell which comprises:

(a) a first planar side wall having a first outer edge and a first inner edge;

(b) a second planar side wall parallel to said first wall and having a corresponding first outer edge and a first inner edge;

(c) an outer planar wall attached orthogonally to said first and second planar side walls; and (d) a multiplicity of spaced rigid reinforcing members attached to first and second planar side walls.

BRIEF DESCRIPTION OF THE DRAWINGS

Other advantages of the invention will become apparent upon reading the description below and the invention will be better understood by references to the attached drawings in which.

DETAILED DESCRIPTION OF THE INVENTION

Figure 1:
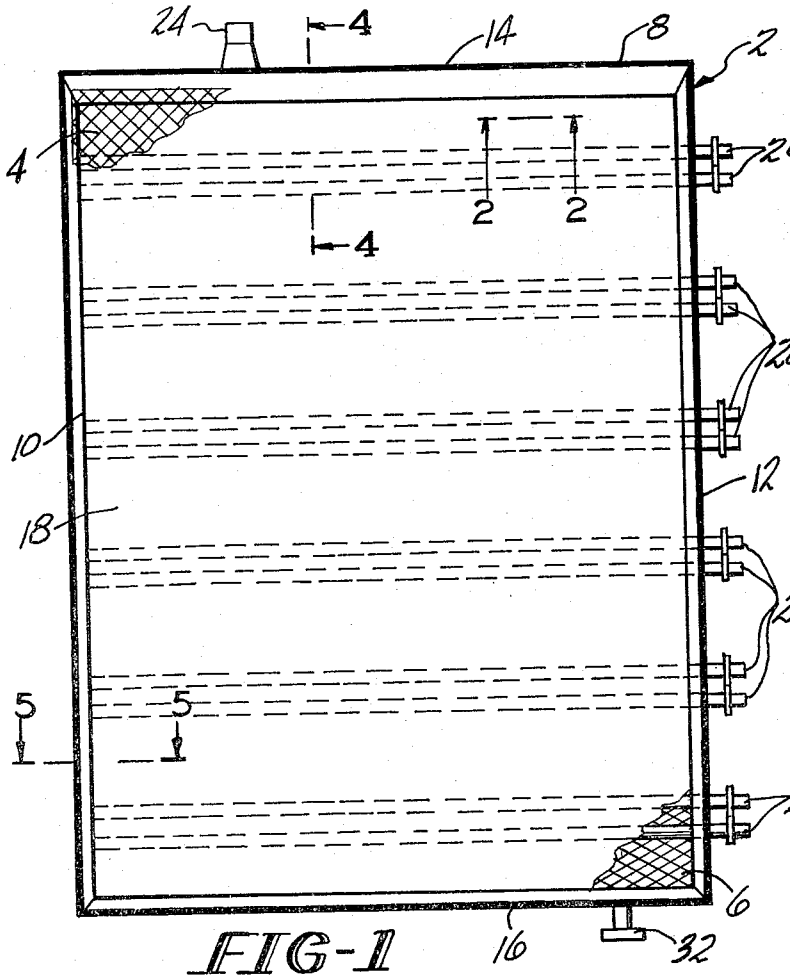
FIG. 1 illustrates a front elevation view of a frame having novel frame components of this invention employed with a preferred electrode with portions cut away.

Electrode 2 of FIG. 1 is comprised of vertical foraminous surfaces 4 and 6 positioned in parallel and spaced apart. Frame 8 has frame components 10, 12, 14, and 16. The frame is typically oriented so that frame component 12 is on the side and frame component 14 is on the top. Foraminous surfaces 4 and 6 are attached to frame 8 to form chamber 18 between foraminous surfaces 4 and 6 and bounded by frame 8. Conductor rods 20 extended through frame 8, are positioned in chamber 18 and are directly attached to foraminous surfaces 4 and 6, and thus supply electric current from conductor rods 20 directly to foraminous surfaces 4 and 6. Frame component 12 has openings for conductor rods 20 which are electrically connected to electrode collectors (not shown) to which terminals (not shown) are attached. Guides (not shown) are included on frame 8 to allow for proper alignment with adjacent electrode frames. Gaskets or other sealant materials (not shown) are suitably placed around frame 8 to permit a series of interleaved anode and cathode frames (not shown) to be sealingly compressed to form a filter press cell (not shown). Outlet 24 passes a cell froth (gas-liquid) produced to a disengager (not shown).

Connection 32 is employed to convey process material into or out of chamber 18.

Frame components 10, 12, 14, and 16 may be in the shape of rectangular bars, U channels, cyclindrical tubes, elliptical tubes as well as being I-shaped or H-shaped. An inverted channel construction (not shown) is preferred for frame component 14 in order to allow frame top component 14 to also serve as a gas collector. Preferably, this top inverted channel is reinforced at its open bottom to prevent bending, buckling, or collapse. Remaining frame components 10, 12, and 16 could be of any suitable configuration which would allow the frame 8 to be pressed together against a gasket (not shown) in order to achieve a fluid-tight seal (not shown). While a flat front and rear surface is preferably for the frame components 10, 12, 14, and 16, it would be possible to have many other configurations such as round or even ridged channels. The foraminous surfaces 4 and 6 shown in FIG. 1 may be welded to the outside of frame components 10, 12, 14, and 16 of frame 8, but may also be welded to the front and back outside surfaces if the configuration of such outside surfaces did not interfere with gasket sealing when the electrode surfaces were on the outside rather than the inside.

The term "channel" as employed throughout the description and claims refers to a bar, preferably metal of flattened U-shaped section but includes grooved or furrous configurations as well.

Figure 2:
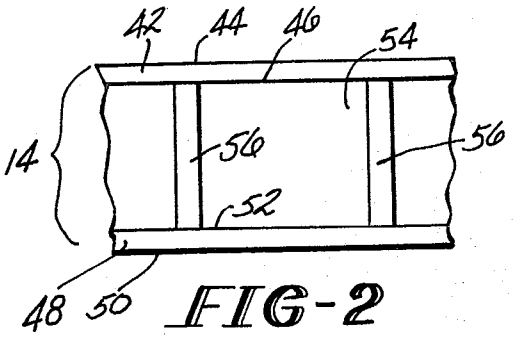
FIG. 2 is a bottom cross sectional view of the top channel of the frame of FIG. 1, taken along lines 2—2 of FIG. 1.

FIG. 2 shows a portion of frame component 14 for a filter press type electrolytic cell (not shown). Frame component 14 comprises first planar side wall 42 having a first outer edge 44 and first inner edge 46, a second planar side wall 48 parallel to the first side wall 42 and having a corresponding first outer edge 50 and first inner edge 52. An outer planar wall 54 is attached orthogonally to first and second planar side walls 42 and 48. A multiplicity of rigid reinforcing rods 56 are attached respectively to first and second planar side walls 42 and 48.

Figure 3:
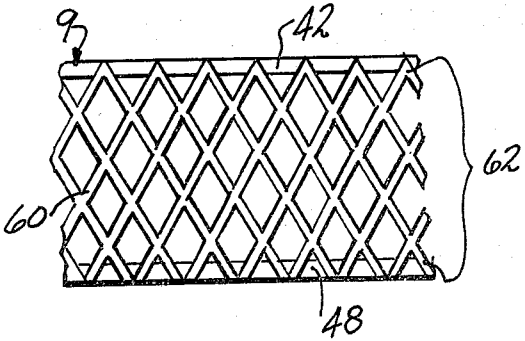
FIG. 3 is a bottom cross sectional view similar to the view of FIG. 2 except showing a modified top channel reinforced with a mesh structure.

FIG. 3 shows a portion of an alternate frame component 9 of this invention having reinforcing members 60 interconnected forming mesh 62 which is attached to first and second planar side walls 42 and 48.

Figure 4:
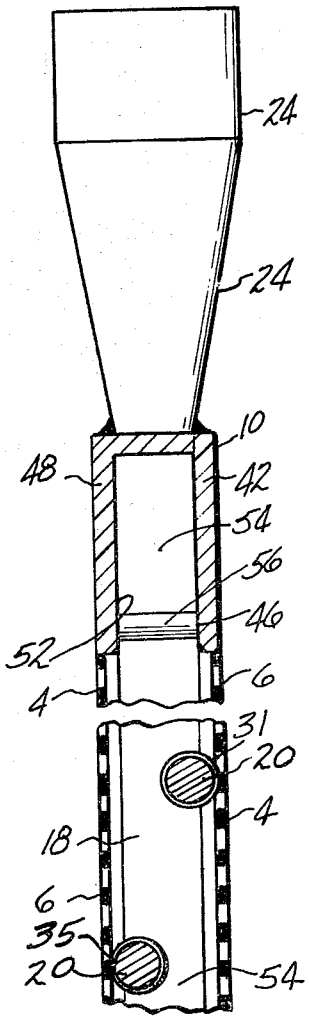
FIG. 4 is a vertical cross section view of the novel frame of this invention from FIG. 1, taken along lines 4—4 of FIG. 1.

FIG. 4 shows outlet 24, an internal portion of frame component 10 of this invention, having a first planar side wall 42 and a second planar side wall 48 parallel to first planar side wall 42. An outer planar wall is attached orthogonally to first outer side wall 42 and to second planar side wall 48. Reinforcing member 56 is shown attached to inner edges 46 and 52 of first and second planar side walls 42 and 48.

In addition, an end view of conductor rods 20 is shown. Conductor rods 20 are joined alternately to foraminous surfaces 4 and 6 within chamber 18 at locations 31 and 35, for example, by welding.

Figure 5:
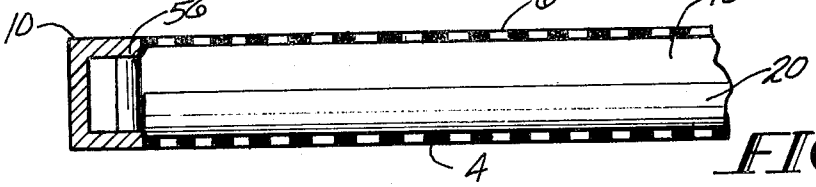
FIG. 5 is a horizontal cross section view of the novel frame of this invention from FIG. 1, taken along lines 5—5 of FIG. 1.
Figure 6:
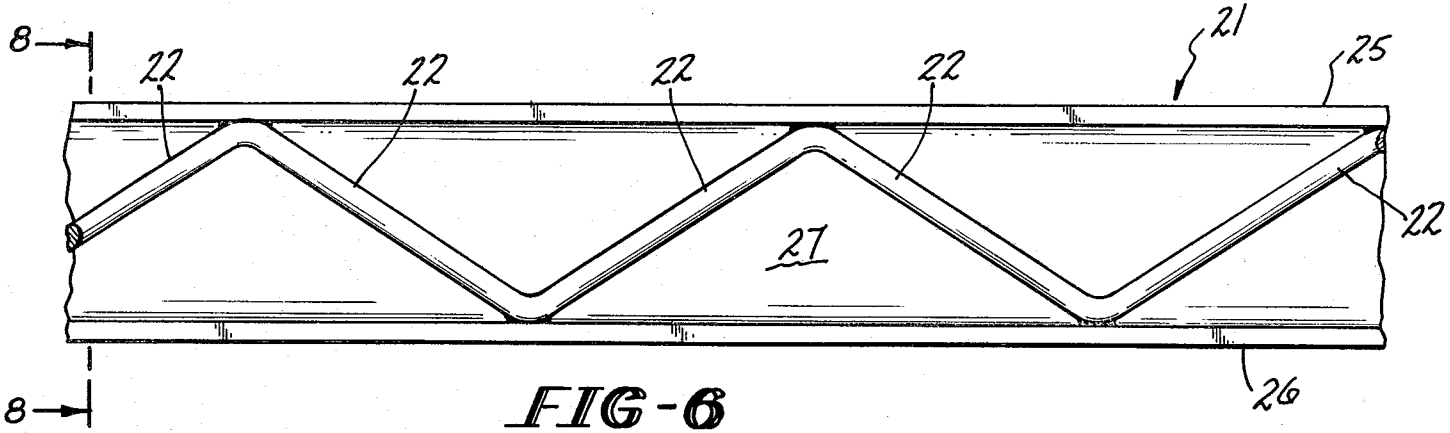
Figure 7:
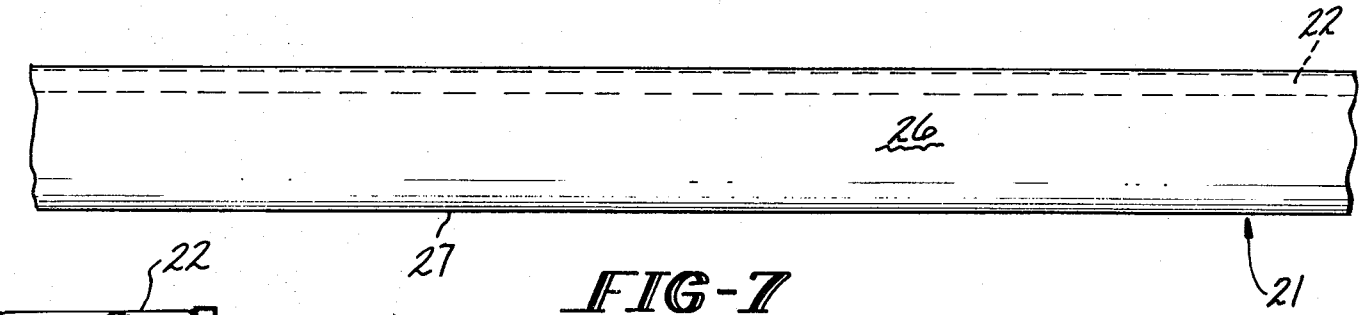
Figure 8:
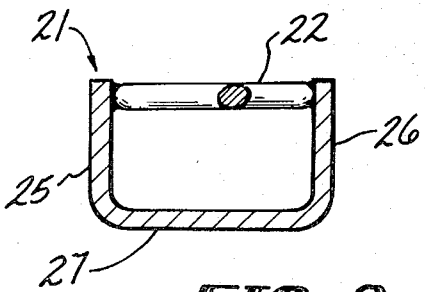

FIG. 5 shows a portion of frame component 10 having reinforcing member 56 joined to frame component 10, conductor rod 20, directly connected to foraminous surface 4, and also foraminous surface 6.

Reinforcing members 56 should be designed to withstand the force applied to provide adequate gasket sealing pressure. While it is preferred to apply gasket pressures of about 100 to about 600 psi; the gasket pressure ranges from about 20 to about 2000 psi. Relatively low pressures, as indicated in the preferred range are favorable to light construction which is a special objective of the invention.

Reinforcing members 56 may be in the shape of rods, squares, flat sections, zig-zag, mesh and the like and may be positioned orthogonally or obliquely between the opposing first and second planar side walls. When employed as anodes, typical materials of construction include titanium and the like. When employed as cathodes, typical materials of construction include steel, nickel, copper, stainless steel, and the like. The thickness of reinforcing members 56 is in the range from about 1/16 to about $\frac{1}{2}$ and preferably from about $\frac{1}{8}$ to about $\frac{1}{4}$ inches, although greater or less thicknesses may be employed, if desired.

Generally, four frame components of similar construction and configuration are attached together at the ends to form electrode frame 8.

The overall size of frame 8 is described in terms of length by width and is in the range from a size of about 0.5 meter by 0.5 meter to a size of about 4 meter by 3 meter, preferably from a size of about 1 by 1 meter, to a size of about 3 meters by 2 meters and most preferably from a size of about 1.5 by 1.1 meters to a size of about 2 by 1.5 meters.

The number of frames 8 per cell (including cathode plus anode frames) is in the range from about 3 to about 50, preferably from about 5 to about 30, and most preferably from about 7 to about 15 frames per cell.

The thickness of frame 8 material is more sensitive to the size range than the other dimensions. The hydrostatic force exerted by the internal operating pressure of the cell outward on frame 8 of electrode chamber 18 is directly proportional to the thickness of chamber 18; whereas, the resisting force exerted by the electrode surfaces 4 and 6 (through its tensile strength) is limited to the allowable tensile strength of the foraminous surface 4 and 6 itself which is a function of the material employed. The thickness of frame 8 must be calculated for the specific design. In this respect, gasket pressure is likely to be more significant than hydraulic pressure. In general, the thickness of frame 8 material is in the range from about 0.05 to about 0.25 and preferably from about 0.08 to about 0.15 inches. It is also preferred to maintain the overall thickness of frame 8 itself in the range of from about 2 to about 10, preferably from about 2.5 to about 6 and most preferably from about 3 to about 5 centimeters.

The material of construction of frame 8 is preferably of the same metal as the foraminous surfaces 4 and 6. Iron, steel, stainless steel, nickel, copper and various alloys of these and other metals may be used for cathode construction although titanium is preferred for anode construction. The proper choice of material allows for the direct resistance welding of foraminous surfaces 4 and 6 to frame 8.

Channel sections of expensive metals, such as titanium and nickel may be fabricated from sheet metal with reinforcement members across the mouth of the channel to support gasket pressure. The beneficial effect is magnified, since thinner metal makes possible thinner electrode frames, which, in turn, makes possible thinner frame sections. Sheet form is available in a wide range of thicknesses at costs which are among the lowest for mill produced shapes, the channels formed from sheet are relatively inexpensive.

The openings required in the sides of the electrode frame for inlets, outlets, and conductors tend to reduce the strength of the frame at points of passage. Without the use of channel as frame, the electrode sections considerably thicker than the size of frame, might be required, simply to provide adequate frame strength. However, channels formed from sheet have considerable advantage over other constructions in that the flanges of the channel are inherently thin and in that the strength of the channel is little reduced by any penetration of its web. The net result is a thinner electrode and a less expensive cell on a unit basis.

Use of the reinforcing members makes possible use of thinner sheet with corresponding savings in cost and space.

The reinforced channel also has a particular usefulness at the top of the electrode compartment. The outer edges form a seal with the membrane (with a gasket) and the interior functions as collector and partial separator for the gas-liquid mixture which exits the top outlet. By providing a height to the top channel, separation of gas from liquid occurs to permit the upper part of the cell to operate with a much higher liquid fraction in the electrolyte than would, otherwise, be attained.

What is claimed is:

1. A frame component for a frame of an electrode for use in a monopolar filter press membrane type of electrolytic cell, the electrode being in a generally vertically upright position during operation, said frame component comprising:

(a) a first planar side wall having a first outer edge and a first inner edge, said outer edge being suitable to fasten a first electrode surface thereto, said fastening thereby defining a first predetermined elongate area of attachment;

(b) a second planar side wall parallel to said first wall and having a corresponding first outer edge and a first inner edge, said first outer edge of said second planar side wall being suitable to fasten a second electrode surface thereto, said fastening thereby defining a second predetermined elongate area of attachment;

(c) an outer planar wall attached orthogonally to said first and second planar side walls; and (d) a multiplicity of spaced rigid reinforcing members horizontally extending between and connected to said first and second planar side walls when the electrode is in the generally vertical upright position, said reinforcing members further being connected to said first and second planar side walls along a plane that does not intersect said first and second predetermined elongate areas of attachment.

2. The frame component of claim 1 wherein said reinforcing members are attached orthogonally to said first inner edge of said parallel first and second planar side walls.

3. The frame component of claim 1, wherein said reinforcing members are oriented obliquely to said side walls.

4. The frame component of claim 1 wherein said reinforcing members are welded to said side walls.

5. The frame component of claim 1, wherein (a) said first side wall, second side wall and outer wall are rectangular and together comprise a top, bottom, and two side channel members; and (b) said reinforcing members are located only in said top channel member.

6. The frame component of claim 1 wherein (a) said first side wall, second side wall and outer wall are rectangular and together comprise a top, bottom, and two side channel members; and (b) said reinforcing members are located in each of said channel members.

7. A frame component for an electrode for use in a monopolar filter press membrane cell comprising;

(a) a first planar side wall having a first outer edge and a first inner edge, said outer edge being suitable to fasten a first electrode surface thereto, said fastening thereby defining a first predetermined elongate area of attachment;

(b) a second planar side wall parallel to said first wall and having a corresponding first outer edge and a first inner edge, said first outer edge of said second planar side walls being suitable to fasten a second electrode surface thereto, said fastening thereby defining a second predetermined elongate area of attachment;

(c) an outer planar wall attached orthogonally to said first and second planar side walls; and (d) a multiplicity of spaced rigid reinforcing members attached to said first and second planar side walls and oriented obliquely thereto.

8. The apparatus according to claim 7 wherein said reinforcing members are interconnected.

9. The apparatus according to claim 8 wherein said reinforcing members further comprise a mesh structure.

10. A generally rectangular frame of a generally planar electrode having first and second opposing electrode surfaces attached thereto, said electrode being used in a monopolar filter press membrane type of electrolytic cell having a plurality of electrodes assembled in generally vertically upright positions and compressively fastened together in a fluid-tight manner, the improvement comprising:

at least one elongate frame component defining the periphery of at least one side of said generally rectangular frame having (a) a first planar side wall with a first outer edge and a second inner edge, said first outer edge having said first electrode surface attached thereto along a generally elongate area of attachment;

(b) a second planar side wall parallel to said first planar side wall and having a corresponding first outer edge and a second inner edge, said first outer edge having said second electrode surface attached thereto along a generally elongate area of attachment;

(c) an outer planar wall attached orthogonally to said first and second planar side walls; and (d) a multiplicity of spaced reinforcing members horizontally extending between and connected to said first and second planar side walls when the electrode is in the generally vertical upright position, said reinforcing members further defining a plane which does not lie in intersecting relationship with said first and second generally elongate areas of attachment.

11. The frame component of claim 10 wherein said reinforcing members are attached orthogonally to said first inner edge of said parallel first and second planar side walls.

12. The frame component of claim 10, wherein said reinforcing members are oriented obliquely to said side walls.

13. The frame component of claim 10 wherein said reinforcing members are welded to said side walls.

* * * * *